US011162185B2

(12) United States Patent
Bagehorn et al.

(10) Patent No.: US 11,162,185 B2
(45) Date of Patent: Nov. 2, 2021

(54) PROCESS FOR THE ELECTROLYTIC POLISHING OF A METALLIC SUBSTRATE

(71) Applicant: AIRBUS DEFENCE AND SPACE GMBH, Taufkirchen (DE)

(72) Inventors: Sarah Bagehorn, Munich (DE); Tobias Mertens, Munich (DE)

(73) Assignee: Airbus Defence and Space GmbH, Taufkirchen (DE)

( * ) Notice: Subject to any disclaimer, the term of this patent is extended or adjusted under 35 U.S.C. 154(b) by 426 days.

(21) Appl. No.: 15/842,652

(22) Filed: Dec. 14, 2017

(65) Prior Publication Data

US 2018/0171504 A1 Jun. 21, 2018

(30) Foreign Application Priority Data

Dec. 21, 2016 (DE) ..... 102016125244.1

(51) Int. Cl.

| | |
|---|---|
| ***C25F 3/18*** | (2006.01) |
| ***C25F 3/16*** | (2006.01) |
| ***C25F 3/24*** | (2006.01) |

(52) U.S. Cl.

CPC ..... *C25F 3/18* (2013.01); *C25F 3/16* (2013.01); *C25F 3/24* (2013.01)

(58) Field of Classification Search

CPC ..... C25F 3/26; C25F 3/08; C25F 3/04; C25F 3/18; C25F 3/20

See application file for complete search history.

(56) References Cited

U.S. PATENT DOCUMENTS

| | | | | |
|---|---|---|---|---|
| 5,028,304 | A | 7/1991 | Stanishevsky et al. | |
| 2003/0102224 | A1* | 6/2003 | Galasco | H05K 1/05 205/125 |
| 2009/0107851 | A1* | 4/2009 | Kodera | B23H 5/08 205/656 |
| 2012/0125786 | A1 | 5/2012 | Clasquin et al. | |

(Continued)

FOREIGN PATENT DOCUMENTS

| | | | |
|---|---|---|---|
| CN | 1249367 | A | 4/2000 |
| CN | 1534113 | A | 10/2004 |
| CN | 1754992 | A | 4/2006 |

(Continued)

OTHER PUBLICATIONS

Website for Inconel 718: http://www.techsteel.net/alloy/Nickel/Inconel-718?campaign=174802741&content=256939613163&keyword=ams5662&gclid=Cj0KCQjw1MXpBRDjARIsAHtdN-2zvtOq1GMmKAu4qP7yGh2uB8nvbBwzAwdEimotHq7OaNHullX01TUaAho8EALw_wcB (Year: 2015).*

(Continued)

*Primary Examiner* — Brian W Cohen

(74) *Attorney, Agent, or Firm* — Jenkins, Wilson, Taylor & Hunt, P.A.

(57) ABSTRACT

The present disclosure is directed a process for the electrolytic polishing of a metallic substrate, including the steps of (i) providing an electrolyte in an electrolytic cell having at least one electrode, (ii) disposing a metallic substrate as an anode in the electrolytic cell, (iii) applying a current at a voltage of 270 to 315 V from a power source between the at least one electrode and the metallic substrate, and (iv) immersing the metallic substrate in the electrolyte, wherein the electrolyte includes at least one acid compound, at least one fluoride compound, and at least one complexing agent.

20 Claims, 1 Drawing Sheet

(56) References Cited

U.S. PATENT DOCUMENTS

| | | | | |
|---|---|---|---|---|
| 2014/0121145 | A1* | 5/2014 | Paasche | C23F 1/18 510/175 |
| 2016/0376724 | A1* | 12/2016 | Bagehorn | C22C 14/00 205/646 |

FOREIGN PATENT DOCUMENTS

| | | | |
|---|---|---|---|
| CN | 101168847 | A | 4/2008 |
| CN | 101798702 | A | 8/2010 |
| CN | 102453444 | A | 5/2012 |
| CN | 102686786 | A | 9/2012 |
| CN | 105420805 | A | 3/2016 |
| CN | 108221041 | B | 6/2021 |
| DE | 10207632 | A1 | 9/2003 |
| EP | 3109348 | A1 | 12/2016 |
| EP | 3269848 | A1 | 1/2018 |
| EP | 3339483 | A1 | 6/2018 |
| GN | 102453444 | B | 12/2013 |
| JP | S 63195300 | A | 8/1988 |
| JP | H 031687 | A | 1/1991 |
| JP | H 03501753 | A | 4/1991 |
| JP | 2018109224 | A | 7/2018 |
| RU | 2127334 | C1 | 3/1999 |

OTHER PUBLICATIONS

European Patent Office, Extended European Search Report for Application No. 17209591.1, dated Apr. 16, 2018.

Japanese Office Action for Application No. 2017240317 dated Aug. 3, 2021.

European Office Action for Application No. 17209591 dated Feb. 22, 2019.

European Office Action for Application No. 17209591 dated Nov. 20, 2019.

Chinese Office Action for Application No. 20171138803 dated Oct. 20, 2020.

* cited by examiner

PROCESS FOR THE ELECTROLYTIC POLISHING OF A METALLIC SUBSTRATE

CROSS-REFERENCE TO PRIORITY APPLICATION

This application claims the benefit of, and priority to, German patent application number 102016125244.1, filed on Dec. 21, 2016. The content of the referenced application is incorporated by reference herein.

TECHNICAL FIELD

Embodiments of the subject matter described herein relate generally to a process for the electrolytic polishing of a metallic substrate.

BACKGROUND

The shaping and surface finishing of metallic substrates has often proven a challenge. In particular the shaping and surface finishing of metallic substrates obtained from generative processes such as additive layer manufacturing often exhibit rough surfaces. The commonly known shaping and surface finishing methods such as for instance blasting, milling, abrasive flow machining are often not applicable to complex surfaces. Furthermore, electrochemical methods are known, such as electrolytic polishing. The electrolytic polishing effect relies on a dissolution reaction occurring on a metallic substrate forming part of an electrolytic cell when a current is applied, wherein the metallic substrate is dissolved into the electrolyte in form of ions. Without wishing to be bound to by a theory, it is believed that an electrolytic film is formed on the surface of the metallic substrate and due to the difference in surface ratio and discharge behavior peaks are dissolved more rapidly than plane surfaces resulting in a reduction of surface roughness. However, state of the art electrolytic polishing processes are often cost and time intensive or do not result in the desired reduction of surface roughness. Furthermore, it is often required to apply hazardous chemicals which require a cumbersome disposal.

It has further been found that in conventional methods for electrolytic polishing of metallic substrates there is a tendency that gas is formed on some spots of the metallic substrates to be polished when a current is applied. The gas emerges locally in bubbles and varying intensity on the metallic substrates. Such formation of gas, for instance due to electrolysis of water contained in the electrolyte or due to electrolytic decomposition of any other component of the electrolyte, however, is disadvantageous since it causes unforeseeable local turbulences in the electrolyte, i.e. there is a locally varying mixing of the electrolyte on the overall surface of the metallic substrate. Furthermore, those parts of the metallic substrate which are temporarily or even for a longer period of time covered with gas bubbles do not have sufficient contact with the electrolyte at all. As a consequence, electrolytic polishing of such parts of the metallic substrate which are in direct contact to or in close proximity to gas (bubbles) formed on the substrate is reduced. This leads to undesired variances of the electrolytic polishing over the entire surface of the metallic substrate, such as for instance small corrugations and/or grooves which appear on the polished surface. This effect is particularly pronounced in case large sized metallic substrates are polished. In other words, the larger the metallic substrate to be polished, the more pronounced the undesired variances of the electrolytic polishing due to gas formation.

Accordingly, it is desirable to provide an electrolytic polishing process which does not suffer from the drawbacks indicated above. Furthermore, other desirable features and characteristics will become apparent from the subsequent detailed description and the appended claims, taken in conjunction with the accompanying drawings and the foregoing technical field and background.

BRIEF SUMMARY

The finding of the present disclosure is a process for the electrolytic polishing of a metallic substrate, resulting in an excellent reduction of surface roughness. The process for the electrolytic polishing of a metallic substrate of the present disclosure comprises the steps of:

providing an electrolyte (EL) in an electrolytic cell comprising at least one electrode, (ii) disposing a metallic substrate as an anode in the electrolytic cell, (iii) applying a current from a power source at a voltage of 270 to 315 V between the at least one electrode and the metallic substrate, and (iv) immersing the metallic substrate in the electrolyte (EL), wherein the electrolyte (EL) comprises (a) at least one acid compound (A), (b) at least one fluoride compound (F), and (c) at least one complexing agent (CA).

In an embodiment, the current is applied at a voltage of 285 to 305 V, preferably at 295 to 305 V, more preferably at 298 to 302 V, and most preferably at 300 V.

In an embodiment, the electrolyte has a temperature in the range of 10 to 95° C., preferably a temperature in the range of 40 to 95° C., more preferably a temperature in the range of 60 to 95° C., even more preferably a temperature in the range of 70 to 90° C., yet even more preferably a temperature in the range of 75 to 85° C.

In an embodiment, the current is applied at a current density in the range of 0.05 to 10 A/cm$^2$, preferably at a current density in the range of 0.05 to 5 A/cm$^2$, more preferably at a current density in the range of 0.1 to 2.5 A/cm$^2$, even more preferably at a current density in the range of 0.1 to 2.0 A/cm$^2$, yet even more preferably at a current density in the range of 0.1 to 1.5 A/cm$^2$.

In an embodiment, the current is applied for a time in the range of 1 to 240 min, preferably for a time in the range of 1 to 120 min, more preferably for a time in the range of 1 to 60 min, even preferably for a time in the range of 1 to 30 min, yet even more preferably for a time in the range of 2 to 20 min.

In an embodiment, the process comprises at least one additional process step of treating the metallic substrate with a cleaning composition.

In an embodiment, the metallic substrate used in the process for the electrolytic polishing of a metallic substrate is selected from the group consisting of Ti-6Al-4V, Inconel 718, Invar and combinations thereof.

In an embodiment, the electrolyte used in the process for the electrolytic polishing of a metallic substrate further comprises (iv) at least one medium (M), and (v) optionally additives (AD).

In an embodiment, the electrolyte (EL) used in the process for the electrolytic polishing of a metallic substrate comprises (i) the at least one acid compound (A) in an amount of not more than 20 wt.-%, preferably in an amount of not more than 15 wt.-%, more preferably in an amount of not more than 10 wt.-%, even more preferably in an amount of not more than 5 wt.-%, like an amount in the range of 0.05 to 20 wt.-%, preferably an amount in the range of 0.5 to 15 wt.-%, more preferably an amount in the range of 1 to 10 wt.-%, even more preferably an amount in the range of 1 to 5 wt.-%, based on the weight of the electrolyte (EL), and/or (ii) the at least one fluoride compound (F) in an amount of not more than 40 wt.-%, preferably in an amount of not more than 30 wt.-%, more preferably in an amount of not more than 15 wt.-%, even more preferably in an amount of not more than 10 wt.-%, like an amount in the range of 1 to 40 wt.-%, preferably an amount in the range of 1 to 30 wt.-%, more preferably an amount in the range of 2 to 15 wt.-%, even more preferably an amount in the range of 4 to 10 wt.-%, based on the weight of the electrolyte (EL), and/or (iii) the at least one complexing agent (CA) in an amount of not more than 30 wt.-%, preferably in an amount of not more than 20 wt.-%, more preferably in an amount of not more than 10 wt.-%, even more preferably in an amount of not more than 5 wt.-%, like an amount in the range of 0.5 to 30 wt.-%, preferably an amount in the range of 0.5 to 20 wt.-%, more preferably an amount in the range of 0.5 to 10 wt.-%, even more preferably an amount in the range of 0.5 to 5 wt.-%, yet even more preferably an amount in the range of 1 to 3 wt. %, based on the weight of the electrolyte (EL).

In an embodiment, the electrolyte (EL) used in the process for the electrolytic polishing of a metallic substrate comprises the at least one acid compound (A) in an amount of not more than 20 wt.-%, preferably in an amount of not more than 15 wt.-%, more preferably in an amount of not more than 10 wt.-%, even more preferably in an amount of not more than 5 wt.-%, like an amount in the range of in the range of 0.05 to 20 wt.-%, preferably an amount in the range of 0.5 to 15 wt.-%, more preferably an amount in the range of 1 to 10 wt.-%, even more preferably an amount in the range of 1 to 5 wt.-%, based on the weight of the electrolyte (EL), and/or (ii) the at least one fluoride compound (F) in an amount of not more than 40 wt.-%, preferably in an amount of not more than 30 wt.-%, more preferably in an amount of not more than 15 wt.-%, even more preferably in an amount of not more than 10 wt.-%, like an amount in the range of 1 to 40 wt.-%, preferably an amount in the range of 1 to 30 wt.-%, more preferably an amount in the range of 2 to 15 wt.-%, even more preferably an amount in the range of 4 to 10 wt.-%, based on the weight of the electrolyte (EL), and/or (iii) the at least one complexing agent (CA) in an amount of not more than 30 wt.-%, preferably in an amount of not more than 20 wt.-%, more preferably in an amount of not more than 10 wt.-%, even more preferably in an amount of not more than 5 wt.-%, like an amount in the range of 0.5 to 30 wt.-%, preferably an amount in the range of 0.5 to 20 wt.-%, more preferably an amount in the range of 0.5 to 10 wt.-%, even more preferably an amount in the range of 0.5 to 5 wt.-%, yet even more preferably an amount in the range of 1 to 3 wt. %, based on the weight of the electrolyte (EL), and/or (iv) the at least one medium (M) in an amount of at least 10 wt.-%, preferably in an amount of at least 30 wt.-%, more preferably in an amount of at least 50 wt.-%, even more preferably in an amount of at least 70 wt.-%, like an amount in the range of 10 to 98.5 wt.-%, preferably an amount in the range of 30 to 95 wt.-%, more preferably an amount in the range of 50 to 90 wt.-%, even more preferably an amount in the range of 70 to 85 wt.-%, based on the weight of the electrolyte (EL), and/or (v) the additives (AD) in an amount of not more than 25 wt.-%, preferably in an amount of not more than 15 wt.-%, more preferably in an amount of not more than 10 wt.-%, even more preferably in an amount of not more than 5 wt.-%, yet even more preferably in an amount of not more than 2 wt.-%, like an amount in the range of 0.01 to 25 wt.-%, preferably an amount in the range of 0.01 to 10 wt.-%, more preferably an amount in the range of 0.01 to 5 wt.-%, even more preferably an amount in the range of 0.01 to 2 wt.-%, based on the weight of the electrolyte (EL).

In an embodiment, the at least one acid compound (A) used in the electrolyte (EL) for the process for the electrolytic polishing of a metallic substrate is selected from the group consisting of inorganic or organic acids such as sulfuric acid, nitric acid, phosphoric acid, hydrochloric acid, formic acid, acetic acid propionic acid, or mixtures thereof, preferably is selected from the group consisting of sulfuric acid, nitric acid, phosphoric acid, or mixtures thereof, more preferably is sulfuric acid.

In an embodiment, the at least one fluoride compound (F) used in the electrolyte (EL) for the process for the electrolytic polishing of a metallic substrate is selected from the group consisting of ammonium fluoride, sodium fluoride, potassium fluoride, magnesium fluoride, calcium fluoride, trifluoracetic acid, or mixtures thereof, preferably is selected from the group consisting of ammonium fluoride, sodium fluoride, potassium fluoride, magnesium fluoride, calcium fluoride, or mixtures thereof, more preferably is ammonium fluoride.

In an embodiment, the at least one complexing agent (CA) used in the electrolyte (EL) for the process for the electrolytic polishing of a metallic substrate is selected from the group consisting of methylglycinediacetic acid (MGDA), ethylenediaminetetraacetate (EDTA), diethylenetriaminepentakismethylenephosphonic acid (DTPMP), aminopolycarboxylic acids (APC), diethylenetriaminepentaacetate (DTPA), nitrilotriacetate (NTA), triphosphate, 1,4,7,10 tetraazacyclododecane-1,4,7,10-tetraacetic acid (DOTA), phosphonate, gluconic acid, β alaninediactetic acid (ADA), N-bis[2-(1,2 dicarboxy-ethoxy)ethyl]glycine (BCA5), N-bis[2-(1,2-dicarboxyethoxy)ethyl]aspatic acid (BCA6), tetracis(2-hydroxypropyl)ethylenediamine (THPED), N-(hydroxyethyl)-ethylenediaminetriacetic acid (HEDTA) or mixtures thereof, preferably is selected from the group consisting of methylglycinediacetic acid (MGDA), ethylenediaminetetraacetate (EDTA), diethylenetriaminepentakismethylenephosphonic acid (DTPMP), aminopolycarboxylic acids (APC), diethylenetriaminepentaacetate (DTPA), tetracis(2-hydroxypropyl)ethylenediamine (THPED), N-(hydroxyethyl)-ethylenediaminetriacetic acid (HEDTA), or mixtures thereof, more preferably is methylglycinediacetic acid (MGDA).

It is to be understood that the invention and the embodiments described above and below are interrelated such that the disclosures supplement each other. For example, any electrolyte described above and below may be applied in the process according to the invention.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
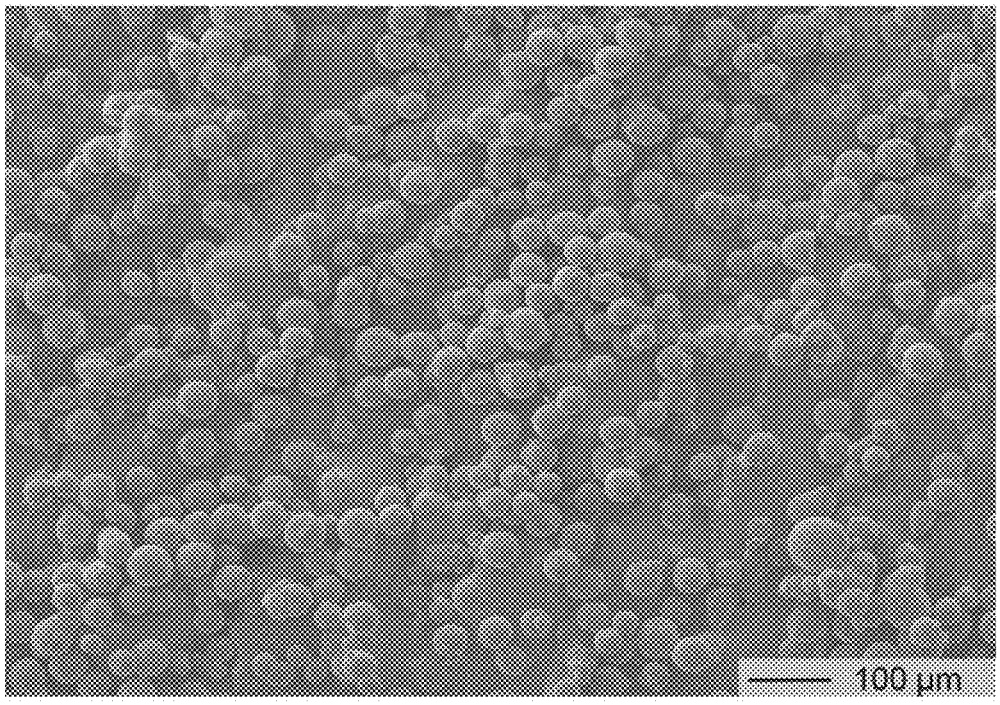
FIG. 1 depicts a SEM image of the metallic substrate Ti-6Al-4V before being treated in the process according to Example 1. The SEM image provides a 100 fold magnification and has been acquired at a voltage of 15,000 kV and a working distance of 4.5 mm.
Figure 2:
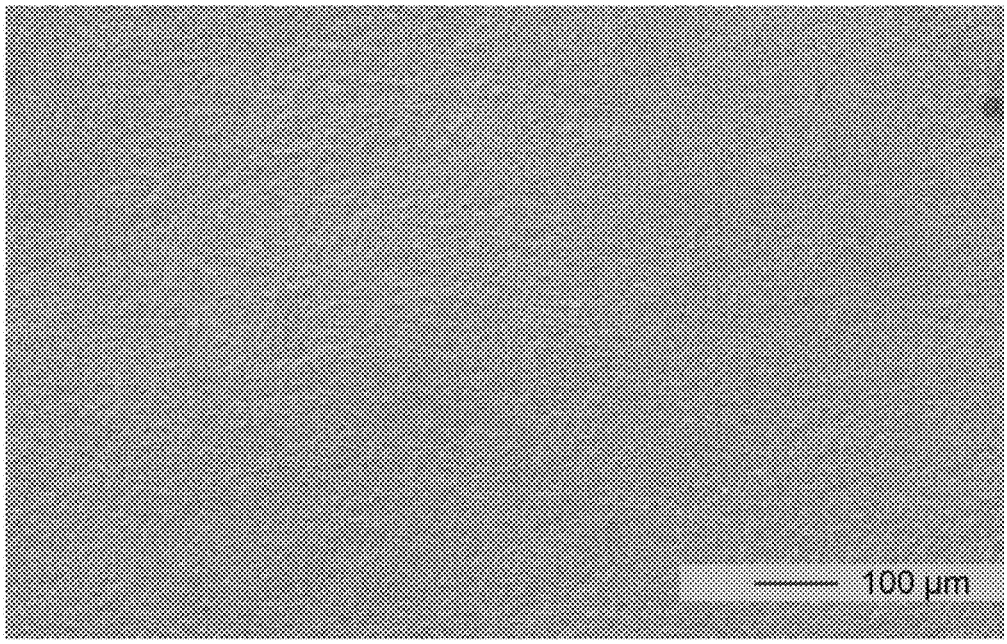
FIG. 2 depicts a SEM image of the metallic substrate Ti-6Al-4V after being treated in the process according to Example 1. The SEM image provides a 100 fold magnification and has been acquired at a voltage of 15,000 kV and a working distance of 14.6 mm.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

Process For The Electrolytic Polishing Of A Metallic Substrate

The disclosure is directed at a process for the electrolytic polishing of a metallic substrate.

A process for the electrolytic polishing of a metallic substrate is described comprising the steps of (i) providing an electrolyte (EL) in an electrolytic cell comprising at least one electrode, (ii) disposing a metallic substrate as an anode in the electrolytic cell, (iii) applying a current from a power source at a voltage of 270 to 315 V between the at least one electrode and the metallic substrate, and (iv) immersing the metallic substrate in the electrolyte (EL)

wherein the electrolyte (EL) comprises (a) at least one acid compound (A), (b) at least one fluoride compound (F), and (c) at least one complexing agent (CA).

The term "electrolytic cell" as used according to the present disclosure is directed at an electrochemical cell that undergoes a redox reaction when electrical energy is applied. In particular an electrochemical cell containing an electrolyte through which an externally generated electric current is passed by a system of electrodes in order to produce an electrochemical reaction. The electrolytic cell can be used to decompose a metallic substrate, in a process called electrolysis.

In accordance with the present disclosure the electrolyte (EL) is provided in an electrolytic cell which also contains a suitable cathode. In a preferred embodiment, the electrolytic cell comprises a container receiving the electrolyte wherein the container is made the cathode of the electrolytic cell. However, it is also possible that at least one separate electrode is present in the electrolytic cell which is made the cathode of the electrolytic cell. Furthermore, it is also possible that the electrolytic cell comprises a container receiving the electrolyte and at least one separate electrode, wherein both container and the at least one separate electrode are made the cathode of the electrolytic cell. The cathode material is not critical and suitable materials include copper, nickel, mild steel, stainless steel, graphite, carbon and the like.

In a preferred embodiment, the surface of the cathode and the surface of the anode have a surface ratio of at least 10:1, preferably a surface ratio of at least 12:1, even more preferably a surface ratio of at least 15:1, like a surface ratio in the range of 10:1 to 100:1, preferably a surface ratio in the range of 12:1 to 100:1, more preferably a surface ratio in the range of 12:1 to 50:1, even more preferably a surface ratio in the range of 12:1 to 20:1.

In a preferred embodiment, the current from a power source is applied between the at least one electrode and the metallic substrate, i.e. between the cathode and the anode of the electrolytic cell before the metallic substrate is immersed in the electrolyte (EL). In other words, in a preferred embodiment process step (iii) is conducted before process step (iv). However, it is also possible that the current from a power source is applied between the at least one electrode and the metallic substrate, i.e. between the cathode and the anode of the electrolytic cell after the metallic substrate has been immersed in the electrolyte (EL). In other words, in a further embodiment process step (iii) is conducted after process step (iv).

An electrolyte [EL] as described above and below is used in the process of the present disclosure. Thus, the electrolyte (EL) used in the process for the electrolytic polishing of a metallic substrate of the present disclosure comprises at least one acid compound (A), at least one fluoride compound (F), and at least one complexing agent (CA).

In a preferred embodiment, the electrolyte (EL) preferably used in the process for the electrolytic polishing of a metallic substrate of the present disclosure consists of at least one acid compound (A), at least one fluoride compound (F), at least one complexing agent (CA), at least one medium (M), and optionally additives (AD).

It is to be understood that the information provided above and below with respect to the at least one acid compound (A), the at least one fluoride compound (F), the at least one complexing agent (CA), the at least one medium (M) and optionally additives (AD) mutually applies to the inventive process for the electrolytic polishing of a metallic substrate in presence of at least one acid compound (A), at least one fluoride compound (F), at least one complexing agent (CA), at least one medium (M) and/or optionally additives (AD).

It is an advantage of the present disclosure that the process for the electrolytic polishing of a metallic substrate can inter alia be applied to metallic substrates with complex surfaces. Thus, the metallic substrate may be in any form such as, for example, bars, plates, flat sheets, sheets of expanded metal, cuboids, or complex structures.

It is a further advantage of the present disclosure that in the process for the electrolytic polishing of a metallic substrate the formation of gas bubbles on the metallic substrate is effectively suppressed. Hence, the process of the present disclosure provides a polished substrate having very good or even excellent homogeneity of polishing even if large metallic substrates such as for instance metallic parts for aircraft systems such as for instance supports and/or brackets (for instance FCRC (flight crew rest compartment) Brackets or brackets for pipes, tubes, cupboards, beds, etc.), room divider and/or cabin divider, spoiler or parts of a spoiler, bends, pipe elbows, etc., are electrolytically polished. Additionally, the process of the present disclosure may provide a polished substrate having a shiny appearance. Such shiny appearance is desirable since it is indicative for excellent homogeneity of polishing.

The term "metallic substrate" as used herein is meant to encompass substrates comprising at least one conductive metal or metal alloy. Preferably the metallic substrate consists of at least one conductive metal or metal alloy. It is appreciated that the metallic substrate comprises, preferably consists of, metals selected from the group consisting of aluminum, titanium, vanadium, chromium, manganese, iron, cobalt, nickel, copper, niobium, molybdenum, silver, hafnium, tungsten, platinum, gold, steel and combinations thereof, such as alloys, preferably selected from the group consisting of aluminum, titanium, vanadium, chromium, manganese, iron, cobalt, nickel, copper, niobium, molybdenum, steel and combinations thereof, such as alloys, more preferably selected from the group consisting of aluminum, titanium and vanadium, and combinations thereof, such as alloys. In a preferred embodiment, the metal substrate is selected from the group consisting of Ti-6Al-4V, Inconel 718, Invar and combinations thereof. Inconel 718 is a metal alloy consisting of 50.00-55.00 weight-% nickel (plus cobalt), 17.00-21.00 weight-% chromium, 4.75-5.50 weight % niobium (plus tantalum), 2.80-3.30 weight-% molybdenum, 0.65-1.15 weight-% titanium, 0.20-0.80 weight-% aluminum, max. 1 weight-% cobalt, max. 0.08 weight-% carbon, max. 0.35 weight-% manganese, max. 0.35 weight-% silicon, max. 0.015 weight-% phosphorus, max. 0.015 weight % sulfur, max. 0.006 weight-% boron and max 0.30 weight-% copper, the balance being iron and unavoidable impurities. Invar is an alloy of iron and nickel commonly known to the skilled person, such as for instance FeNi36 (i.e. an alloy of around 64 parts iron and around 36 parts nickel) or Fe65Ni35 (i.e. an alloy of around 65 parts iron and around 35 parts nickel), and in the present disclosure preferably is FeNi36.

It has been found that the process for the electrolytic polishing of a metallic substrate of the present disclosure results in a very good reduction of surface roughness and very good homogeneity of the obtained polished surface at voltages between 275 and 315 V.

It is appreciated that the current is preferably applied at a voltage of 285 to 305 V, more preferably at 295 to 305 V, even more preferably at 298 to 302 V and most preferably at 300 V. In particular, if the current is applied at a voltage of 298 to 302 V or even at 300 V, an excellent reduction of surface roughness and excellent homogeneity of the obtained polished surface is achieved.

Furthermore, it is appreciated that the current may be applied applied at a current density in the range of 0.05 to 10 A/cm$^2$, preferably at a current density in the range of 0.05 to 5 A/cm$^2$, more preferably at a current density in the range of 0.1 to 2.5 A/cm$_2$, even more preferably at a current density in the range of 0.1 to 2.0 A/cm$^2$, yet even more preferably at a current density in the range of 0.1 to 1.5 A/cm$^2$.

The temperature does not appear to be a critical parameter. However, an increased temperature seems to improve the efficiency of the process for the electrolytic polishing of a metallic substrate. It is appreciated that the temperature of the electrolyte is at least 10° C., preferably is at least 40° C., more preferably is at least 60° C., even more preferably is at least 70° C., yet even more preferably is at least 75° C., like a temperature in the range of 10 to 95° C., preferably a temperature in the range of 40 to 95° C., more preferably a temperature in the range of 60 to 95° C., even more preferably a temperature in the range of 70 to 90° C., yet even more preferably a temperature in the range of 75 to 85° C.

The treatment time is generally within the range of 1 to 240 min. However, the treatment of some metallic substrates may require a shorter or longer treatment for the desired reduction in surface roughness, depending on factors such as initial surface roughness and desired surface roughness, surface area, surface geometry and the like. In a preferred embodiment, the current is applied for a time in the range of 1 to 240 min, preferably for a time in the range of 1 to 120 min, more preferably for a time in the range of 1 to 60 min, even preferably for a time in the range of 1 to 30 min, yet even more preferably for a time in the range of 2 to 20 min.

In a preferred embodiment, the electrolyte is continuously agitated during the process for the electrolytic polishing of a metallic substrate. There are various methods of agitating an electrolyte during electrolytic polishing of a metallic substrate. The agitation may be achieved by immersing a pressurized gas. Suitable gases for immersion are for example, nitrogen, hydrogen, helium, argon, and combinations thereof. During immersion the pressurized gas is bubbled through the electrolyte. The pressurized gas may have a pressure in the range of 0.01 to 1000 kg/cm$^2$, preferably a pressure in the range of 1 to 1000 kg/cm$^2$.

It may be beneficial for the process for the electrolytic polishing of a metallic substrate if the metallic substrate is subjected to pre- or post-treatment steps, such as treating the metallic substrate with a cleaning composition. In an embodiment, the process for the electrolytic polishing of a metallic substrate comprises a post-treatment step of treating the metallic substrate with a cleaning composition, preferably a post-treatment step of treating the metallic substrate with water, preferably deionized water.

The process for the electrolytic polishing of a metallic substrate provides metallic substrates with reduced surface roughness. Furthermore, the process for the electrolytic polishing of a metallic substrate provides metallic substrates having excellent homogeneity of the polished surface even if larger sized metallic substrates are polished.

It is appreciated that the average surface roughness ($R_a$) of a metallic substrate treated according to the process for the electrolytic polishing of a metallic substrate described is reduced by at least 0.1 μm, preferably is reduced by at least 0.5 μm, even more preferably is reduced by at least 1.0 μm, like in the range of 0.1 to 100 μm, preferably in the range of 0.5 to 20 μm, more preferably in the range of 0.5 to 10 μm, even more preferably in the range of 1.0 to 10 μm, and most preferably in the range of 5.0 to 10 μm.

Furthermore, it is appreciated that from the process for the electrolytic polishing of a metallic substrate described a metallic substrate is obtained with an average surface roughness ($R_a$) of not more than 15 μm, preferably of not more than 10 μm, preferably of not more than 5 μm, more preferably of not more than 1 μm, even more preferably of not more than 0.5 μm, yet even more preferably of not more than 0.1 μm, like an average surface roughness ($R_a$) in the range of 10 to 0.01 μm, preferably an average surface roughness ($R_a$) in the range of 5 to 0.01 μm, more preferably an average surface roughness ($R_a$) in the range of 1 to 0.01 μm, even more preferably an average surface roughness ($R_a$) in the range of 0.5 to 0.01 μm, yet even more preferably an average surface roughness ($R_a$) in the range of 0.1 to 0.01 μm.

A particular preferred process of the present disclosure comprises the following steps:

providing an electrolyte (EL) in an electrolytic cell comprising at least one electrode, (ii) disposing a metallic substrate which is selected from the group consisting of Ti-6Al-4V, Inconel 718, Invar and combinations thereof as an anode in the electrolytic cell, (iii) applying a current from a power source at a voltage of 270 to 315 V, preferably at 285 to 305 V, more preferably at 295 to 305 V, even more preferably at 298 to 302 V and most preferably at 300 V between the at least one electrode and the metallic substrate, and (iv) immersing the metallic substrate in the electrolyte (EL), wherein the electrolyte (EL) comprises (a) at least one acid compound (A), (b) at least one fluoride compound (F), and (c) at least one complexing agent (CA).

Applying the particular preferred process the average surface roughness of the used substrates can be significantly reduced, i.e. the obtained substrates have a very low average surface roughness, and, at the same time, the resulting polished surface has an an excellent homogeneity.

The electrolyte (EL) is described in more detail above and below in particular in the section "The Electrolyte".

The Electrolyte (EL)

In the process of the present disclosure, an electrolyte (EL) for the electrolytic polishing of a metallic substrate with excellent long-term stability and efficiency of surface roughness reduction is used.

The term "electrolyte" as used according to the present disclosure is directed at a fluid that can be applied in an electrolytic cell as conducting medium in which the flow of current is accompanied by the movement of matter in the form of ions.

The electrolyte (EL) for the electrolytic polishing of a metallic substrate comprises at least one acid compound (A), at least one fluoride compound (F), and at least one complexing agent (CA).

In a preferred embodiment, the electrolyte (EL) does not comprise any other acid compounds, fluoride compounds and complexing agents beside the at least one acid compound (A), the at least one fluoride compound (F), and the at least one complexing agent (CA).

In a preferred embodiment, the electrolyte (EL) is acidic. It is appreciated that the electrolyte has a pH of not more than 6.5, preferably a pH of not more than 6.0, more preferably a pH of not more than 5.5, like a pH in the range of 0.5 to 6.5, preferably a pH in the range of 1.0 to 6.0, more preferably a pH in the range of 2.0 to 5.5, even more preferably a pH in the range of 3.0 to 5.0.

The Acid Compound (A)

The term "acid compound" as used according to the present disclosure is directed at an organic or inorganic compound that can accept a pair of electrons to form a covalent bond.

The at least one acid compound (A) is an essential constituent of the electrolyte (EL). The at least one acid compound (A) increases the conductivity of the electrolyte and may benefit an electrolytic polishing process as a catalyst depending on the metallic substrate to be treated.

Preferably the at least one acid compound (A) is comprised in the electrolyte (EL) in an amount of not more than 20 wt.-%, preferably in an amount of not more than 15 wt.-%, more preferably in an amount of not more than 10 wt.-%, even more preferably in an amount of not more than 5 wt.-%, like an amount in the range of in the range of 0.05 to 20 wt.-%, preferably an amount in the range of 0.5 to 15 wt. %, more preferably an amount in the range of 1 to 10 wt.-%, even more preferably an amount in the range of 1 to 5 wt.-%, based on the weight of the electrolyte (EL).

It is appreciated that the at least one acid compound (A) is selected from the group consisting of inorganic or organic acids such as sulfuric acid, nitric acid, phosphoric acid, hydrochloric acid, formic acid, acetic acid propionic acid, or mixtures thereof, preferably is selected from the group consisting of sulfuric acid, nitric acid, phosphoric acid, or mixtures thereof, more preferably is sulfuric acid.

In a preferred embodiment, the at least one acid compound (A) is aqueous sulfuric acid, wherein sulfuric acid is comprised in an amount in the range of 100 to 20 wt. %, preferably in an amount in the range of 98 to 50 wt.-%, more preferably in an amount in the range of 98 to 80 wt.-%, even more preferably in an amount in the range of 98 to 90 wt.-%, based on the weight of the at least one acid compound (A).

Thus, it is not required to include toxic acid compounds requiring cumbersome disposal, such as hydrofluoric acid, which is disclosed as a suitable acid compound for the electrolytic polishing of metallic substrates in the state of the art.

The Fluoride Compound (F)

The term "fluoride compound" as used according to the present disclosure is directed at a compound that can serve as a source of fluoride ions. Depending on the metallic substrate to be treated in an electrolytic polishing process fluoride ions may be required to support the dissolution process, for example by forming stable complexes with dissolved metal ions.

Preferably the at least one fluoride compound (F) is comprised in the electrolyte (EL) in an amount of not more than 40 wt.-%, preferably in an amount of not more than 30 wt. %, more preferably in an amount of not more than 15 wt.-%, even more preferably in an amount of not more than 10 wt.-%, like an amount of in the range of 1 to 40 wt.-%, preferably an amount in the range of 1 to 30 wt.-%, more preferably in an amount the range of 2 to 15 wt.-%, even more preferably an amount in the range of 4 to 10 wt.-%, based on the weight of the electrolyte (EL).

It is appreciated that the at least one fluoride compound (F) is selected from the group consisting of ammonium fluoride, sodium fluoride, potassium fluoride, magnesium fluoride, calcium fluoride, trifluoracetic acid, or mixtures thereof, preferably is selected from the group consisting of ammonium fluoride, sodium fluoride, potassium fluoride, magnesium fluoride, calcium fluoride, or mixtures thereof, more preferably is ammonium fluoride.

It is believed that the application of ammonium fluoride additionally benefits the process of electrolytic polishing of metallic substrates by providing a cationic wetting agent ($NH_4$+) which modifies the polarization of the electrodes.

The Complexing Agent (CA)

The term "complexing agent" as used according to the present disclosure is directed at compounds that form coordinate bonds with a metal atom or ion. Chelating agents are complexing agents that form a particular type of complex, that involves the formation or presence of two or more separate coordinate bonds between a polydentate (multiple bonded) ligand and a multivalent single central atom. Usually these ligands are organic compounds, and are called chelants, chelators, chelating agents, or sequestering agents. The term "complexing agent" includes both non-chelating complexing agents and chelating complexing agents, the latter being preferred.

The at least one complexing agent (CA) is an essential constituent of the electrolyte (EL). The at least one complexing agent (CA) benefits the long-term stability of the electrolyte (EL) and increases the efficiency of surface roughness reduction achieved by electrolytic polishing of a metallic substrate.

Preferably the at least one complexing agent (CA) is comprised in the electrolyte (EL) in an amount of not more than 30 wt.-%, preferably in an amount of not more than 20 wt.-%, more preferably in an amount of not more than 10 wt.-%, even more preferably in an amount of not more than 5 wt.-%, like an amount in the range of 0.5 to 30 wt.-%, preferably an amount in the range of 0.5 to 20 wt.-%, more preferably an amount in the range of 0.5 to 10 wt.-%, even more preferably an amount in the range of 0.5 to 5 wt.-%, yet even more preferably an amount in the range of 1 to 3 wt. %, based on the weight of the electrolyte (EL).

It is appreciated that the at least one complexing agent (CA) is selected from the group consisting of methylglycinediacetic acid (MGDA), ethylenediaminetetraacetate (EDTA), diethylenetriaminepentakismethylenephosphonic acid (DTPMP), aminopolycarboxylic acids (APC), diethylenetriaminepentaacetate (DTPA), nitrilotriacetate (NTA), triphosphate, 1,4,7,10 tetraazacyclododecane-1,4,7,10-tetraacetic acid (DOTA), phosphonate, gluconic acid, β alaninediactetic acid (ADA), N-bis[2-(1,2 dicarboxy-ethoxy) ethyl]glycine (BCAS), N-bis[2-(1,2-dicarboxyethoxy)ethyl] aspatic acid (BCA6), tetracis(2-hydroxypropyl) ethylenediamine (THPED), N-(hydroxyethyl)-ethylenediaminetriacetic acid (HEDTA) or mixtures thereof, preferably is selected from the group consisting of methylglycinediacetic acid (MGDA), ethylenediaminetetraacetate (EDTA), diethylenetriaminepentakismethylenephosphonic acid (DTPMP), aminopolycarboxylic acids (APC), diethylenetriaminepentaacetate (DTPA), tetracis(2-hydroxypropyl) ethylenediamine (THPED), N-(hydroxyethyl)-ethylenediaminetriacetic acid (HEDTA), or mixtures thereof, more preferably is methylglycinediacetic acid (MGDA).

The Medium (M)

The electrolyte (EL) may comprise at least one medium (M). The term "medium" as used according to the present disclosure is directed at any organic or inorganic compound suitable for providing a medium wherein the electrolytic polishing of metallic substrates can be conducted. Preferably the at least one medium (M) benefits the process of electrolytic polishing of metallic substrates, for example by increasing the conductivity of the electrolytic cell, by stabilizing the complexes formed by the at least one complexing agent (CA) and/or by providing a sufficient solubility with respect to the compounds comprised in the electrolyte (EL).

Preferably the at least one medium (M) is comprised in the electrolyte (EL) in an amount of at least 10 wt.-%, preferably in an amount of at least 30 wt.-%, more preferably in an amount of at least 50 wt.-%, even more preferably in an amount of at least 70 wt.-%, like an amount in the range of 10 to 98.5 wt.-%, preferably an amount in the range of 30 to 95 wt.-%, more preferably an amount in the range of 50 to 90 wt.-%, even more preferably an amount in the range of 70 to 85 wt.-%, based on the weight of the electrolyte (EL).

It is appreciated that the at least one medium (M) is selected from the group consisting of water, alcohols, ethers, esters, carboxylic acids, and mixtures thereof, like $C_1$ to $C_8$ aliphatic alcohols, $C_1$ to $C_8$ aliphatic ethers, $C_1$ to $C_8$ aliphatic esters, $C_1$ to $C_8$ aliphatic carboxylic acids, and mixtures thereof, preferably from the group consisting of water, alcohols, ethers, and mixtures thereof, like $C_1$ to $C_8$ aliphatic alcohols, $C_1$ to $C_8$ aliphatic ethers, and mixtures thereof. In a preferred embodiment, the at least one medium (M) is water.

In a preferred embodiment, the term "water" is directed at deionized water.

In an embodiment, the at least one medium (M) is an electrolyte which is compounded with the at least one acid compound (A), the at least one fluoride compound (F), the at least one complexing agent (CA) and optionally additives (AD) to form the electrolyte (EL). In a preferred embodiment, the at least one medium (M) is water which is compounded with the at least one acid compound (A), the at least one fluoride compound (F), the at least one complexing agent (CA) and optionally additives (AD) to form the electrolyte (EL). In other words, in a preferred embodiment the electrolyte (EL) is an aqueous electrolyte comprising the at least one acid compound (A), the at least one fluoride compound (F) and the at least one complexing agent (CA).

The Additives (AD)

The electrolyte (EL) may comprise additional additives (AD) that are applied in the electrolytic polishing of metallic substrates to benefit the process. Typical additives are known to a person skilled in the art of electrolytic polishing of metallic substrates and are applied according to needs. Typical additives for the electrolytic polishing of metallic substrates are for example surfactants, polyvalent alcohols, silicates, thickeners, and the like.

It is appreciated that the additives (AD) are present in the electrolyte (EL) in an amount of not more than 25 wt.-%, preferably in an amount of not more than 15 wt.-%, more preferably in an amount of not more than 10 wt.-%, even more preferably in an amount of not more than 5 wt.-%, yet even more preferably in an amount of not more than 2 wt.-%, like an amount in the range of 0.01 to 25 wt.-%, preferably an amount in the range of 0.01 to 10 wt.-%, more preferably an amount in the range of 0.01 to 5 wt.-%, even more preferably an amount in the range of 0.01 to 2 wt.-%, based on the weight of the electrolyte (EL).

EXAMPLES

Definitions and Measuring Methods

The average surface roughness ($R_a$) is determined according to DIN EN 4287:1998-10 using the tactile incision technique according to DIN EN ISO 3274 (Hommel Tester T1000 Wave of Jenoptik, tipradius 5 μm, taper angle 90°)

The pH is determined according to DIN 19261:2005-6.

The quality of polishing, i.e. the homogeneity of the polishing over the entire metallic substrate, is further visually observed and assessed as follows:

-- poor quality: plenty of corrusions and/or grooves, inhomogeneous reduction of the surface roughness

- minor quality: some corrusions and/or grooves, less homogenous reduction of the surface roughness + very good quality: only very minor corrusions and/or grooves, homogenous reduction of the surface roughness ++ excellent quality: no corrusions and/or grooves, homogenous reduction of the surface roughness

Example 1

A metallic substrate in form of a 32 mm×16 mm×30 mm metal plate of Ti-6Al-4V with an initial average surface roughness of $R_a$=20.0 μm is disposed as an anode in an electrolytic cell comprising a stainless steel cathode. A current of 300 V is applied from a direct current power source between the cathode and the metallic substrate. The metallic substrate is immersed in an electrolyte consisting of 6 wt. % $NH_4F$, 4 wt.-% $H_2SO_4$ and 1 wt.-% MGDA. The electrolyte has a pH of 3.5. The metallic substrate is treated for 30 min. A final average surface roughness of $R_a$=2.0 μm is achieved. The homogeneity of the polishing of the polished substrate is excellent. No corrugations or grooves can be visually observed on the polished substrate. The polished substrate has a shiny appearance.

Example 2

The influence of the applied voltage on the reduction of the average surface roughness in the range from 250 to 350 V is assessed.

A series of experiments 2-1 to 2-7 is performed. For every independent experiment of this series, a metallic substrate in form of a 116 mm×25 mm×30 mm metal plate of Ti-6Al-4V having an initial averaged surface roughness as specified in Table 1 below is disposed independently as an anode in an electrolytic cell comprising a stainless steel cathode. Various currents in the range of 250 to 350 V as specified in Table 1 below are applied independently in each experiment from a direct current power source between the cathode and the metallic substrate. Each metallic substrate is immersed independently in an electrolyte consisting of 6 wt. % $NH_4F$ and 1 wt.-% $H_2SO_4$. The electrolyte has a pH of 3.5. Each metallic substrate is treated for 10 min. In other words, in this series of independent experiments all parameters have been kept constant except of the applied voltage which ranges between 250 and 350 V. A final average surface roughness as specified in Table 1 below is achieved for each independent experiment of the series. The decrease of the surface roughness is expressed by the percental difference of the final roughness in relation to the initial roughness.

TABLE 1

| No. | Voltage [V] | Initial Roughness, $R_a$ [μm] | Final Roughness, $R_a$ [μm] | Percent Difference [%] | Quality Of Polishing |
|---|---|---|---|---|---|
| 2-1 | 250 | 18.7 | 12.3 | 34.3 | − |
| 2-2 | 275 | 18.5 | 11.7 | 36.8 | + |
| 2-3 | 290 | 15.3 | 9.7 | 36.4 | + |
| 2-4 | 300 | 21.1 | 11.6 | 45.0 | + + |
| 2-5 | 310 | 18.4 | 11.0 | 40.3 | + |
| 2-6 | 325 | 17.1 | 13.8 | 19.3 | − |
| 2-7 | 350 | 19.0 | 14.6 | 23.0 | −− |

In experiments 2-2, 2-3, 2-4 and 2-5 (i.e. the experiments applying voltages of 275, 290, 300 and 310) a desirable very high reduction of the surface roughness expressed in the percental difference of the final roughness in relation to the initial roughness is observed. Moreover, in said experiments 2-2, 2-3, 2-4 and 2-5, a significantly reduced formation of gas at the metallic substrate is observed during the electrolytic polishing. Also, no corrugations and/or grooves can be observed on the polished substrates obtained in said experiments 2-2, 2-3, 2-4 and 2-5. The polished surfaces have a shiny appearance (experiments 2-2 to 2-5). In experiments 2-1, 2-6 and 2-7, the reduction of the surface roughness is less and the polished surface of the metallic substrates are of minor quality due to inhomogeneous reduction of the surface roughness and due to formation of corrugations and/or grooves. The polished surfaces have a matt appearance.

Example 3

A metallic substrate in form of a 50 mm×10 mm×20 mm metal plate of Inconel 718 with an initial averaged surface roughness of $R_a$=14 μm is disposed as an anode in an electrolytic cell comprising a stainless steel cathode. A current of 300 V is applied from a direct current power source between the cathode and the metallic substrate. The metallic substrate is immersed in an electrolyte consisting of 6 wt. % $NH_4F$, 4 wt.-% $H_2SO_4$ and 1 wt.-% MGDA. The electrolyte has a pH of 3.5. The metallic substrate is treated for 10 min. A final average surface roughness of $R_a$=4 μm is achieved. The surface of the polished substrate has a shiny appearance. No visually corrugations or grooves can be observed on the polished substrate.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A process for the electrolytic polishing of a metallic substrate, comprising the steps of:

providing an electrolyte in an electrolytic cell comprising at least one electrode;

disposing a metallic substrate as an anode in the electrolytic cell;

applying a current at a voltage of 270 to 315 volts from a power source between the at least one electrode and the metallic substrate; and immersing the metallic substrate in the electrolyte;

wherein the electrolyte comprises at least one acid compound, at least one fluoride compound, and at least one complexing agent.

2. The process according to claim 1, wherein the current is applied at a voltage of 285 to 305 volts.

3. The process according to claim 1, wherein the electrolyte has a temperature in the range of 10 to 95° C.

4. The process according to claim 1, wherein the current is applied at a current density in the range of 0.05 to 10 $A/cm^2$.

5. The process according to claim 1, wherein the current is applied for a time in the range of 1 to 240 min.

6. The process according to claim 1, wherein the metallic substrate includes Ti-6A1-4V.

7. The process according to claim 1, wherein the metallic substrate includes Inconel 718, wherein Inconel 718 is a metal alloy consisting of from 50 to 55 wt. % nickel plus cobalt, from 17 to 21 wt. % chromium, from 4.75 to 5.5 wt. % niobium plus tantalum, from 2.8 to 3.3 wt. % molybdenum, from 0.65 to 1.15 wt. % titanium, from 0.2 to 0.8 wt. % aluminum, no more than 1 wt. % cobalt, no more than 0.8 wt. % carbon, no more than 0.35 wt. % manganese, no more than 0.35 wt. % silicon, no more than 0.015 wt. % phosphorous, no more than 0.015 wt. % sulfur, no more than 0.006 wt. % boron, and no more than 0.3 wt. % copper, with the balance being iron and unavoidable impurities.

8. The process according to claim 1, wherein the metallic substrate includes Invar, wherein Invar is an alloy of iron and nickel.

9. The process according to claim 1, wherein the at least one acid compound is in an amount of from 1 to 5 wt.-%, the at least one fluoride compound is in an amount of from 4 to 10 wt.-%, and the at least one complexing agent is in an amount of from 1 to 3 wt.-%, based on the weight of the electrolyte.

10. The process according to claim 1, wherein the at least one acid compound is in an amount of from 1 to 10 wt.-%, the at least one fluoride compound is in an amount of from 2 to 15 wt.-%, and the at least one complexing agent is in an amount of from 0.5 to 5 wt.-%, based on the weight of the electrolyte.

11. The process according to claim 1, wherein the at least one acid compound is sulfuric acid.

12. The process according to claim 1, wherein the at least one fluoride compound is ammonium fluoride.

13. The process according to claim 1, wherein the at least one complexing agent is methylglycinediacetic acid (MGDA).

14. The process according to claim 1, wherein the current is applied at a voltage of 298 to 302 volts.

15. The process according to claim 1, wherein the electrolyte has a temperature in the range of 75 to 85° C.

16. The process according to claim 1, wherein the current is applied at a current density in the range of 0.1 to 1.5 $A/cm^2$.

17. The process according to claim 1, wherein the electrolyte further comprises at least one medium selected from the group consisting of $C_1$ to $C_8$ aliphatic alcohols, $C_1$ to $C_8$ aliphatic ethers, $C_1$ to $C_8$ aliphatic esters, $C_1$ to $C_8$ aliphatic carboxylic acids, and mixtures thereof.

18. The process according to claim 1, wherein the electrolyte further comprises at least one medium selected from the group consisting of water, alcohols, ethers, esters, carboxylic acids, and mixtures thereof, wherein the electrolyte further includes additives selected from surfactants, polyvalent alcohols, silicates and thickeners, wherein the at least one medium is in an amount of from 70 to 85 wt.-% and the additives are in an amount of from 0.01 to 2 wt.-%, based on the weight of the electrolyte.

19. The process according to claim 1, wherein the at least one acid compound is sulfuric acid, wherein the at least one fluoride compound is ammonium fluoride, and wherein the at least one complexing agent is methylglycinediacetic acid (MGDA).

20. The process according to claim 1, wherein:

the at least one acid compound is selected from the group consisting of sulfuric acid, nitric acid, phosphoric acid, hydrochloric acid, formic acid, acetic acid, propionic acid, or mixtures thereof;

the at least one fluoride compound can serve as a source of fluoride ions;

the at least one complexing agent is selected from the group consisting of methylglycinediacetic acid (MGDA), ethylenediaminetetraacetate (EDTA), diethylenetriaminepentakismethylenephosphonic acid (DTPMP), aminopolycarboxylic acids (APC), diethylenetriaminepentaacetate (DTPA), nitrilotriacetate (NTA), triphosphate, 1,4,7,10 tetraazacyclododecane-1,4,7,10-tetraacetic acid (DOTA), phosphonate, gluconic acid, β alaninediactetic acid (ADA), N-bis[2-(1,2 dicarboxy-ethoxy)ethyl]glycine (BCA5), N-bis[2-(1,2-dicarboxyethoxy)ethyl]aspatic acid (BCA6), tetracis(2-hydroxypropyl)ethylenediamine (THPED), N-(hydroxyethyl)-ethylenediaminetriacetic acid (HEDTA) or mixtures thereof; and the at least one acid compound is in an amount of not more than 20 wt.-%, the at least one fluoride compound is in an amount of not more than 40 wt.-%, and the at least one complexing agent is in an amount of not more than 30 wt.-%, based on the weight of the electrolyte.

* * * * *